United States Patent [19]

Yuguchi et al.

[11] Patent Number: 4,541,625

[45] Date of Patent: Sep. 17, 1985

[54] SHEET FILM SUPPLY APPARATUS

[75] Inventors: Naoki Yuguchi, Yokohama; Keiichi Kawasaki, Tokyo, both of Japan

[73] Assignee: Canon Kabushiki Kaisha, Tokyo, Japan

[21] Appl. No.: 519,924

[22] Filed: Aug. 3, 1983

Related U.S. Application Data

[63] Continuation of Ser. No. 230,501, Feb. 2, 1981, abandoned.

[30] Foreign Application Priority Data

Feb. 12, 1980 [JP] Japan ..... 55-15776
Feb. 15, 1980 [JP] Japan ..... 55-17404

[51] Int. Cl.[4] ..... B65H 3/24
[52] U.S. Cl. ..... 271/42; 271/109; 271/233
[58] Field of Search ..... 271/233, 19, 24, 25, 271/42, 128, 161, 167, 171, 109

[56] References Cited

U.S. PATENT DOCUMENTS

| | | | |
|---|---|---|---|
| 1,009,289 | 11/1911 | Duffy | 271/42 |
| 1,235,518 | 7/1917 | Halvorsen | 271/19 |
| 3,645,527 | 2/1972 | Gates | 271/42 |
| 3,743,276 | 7/1973 | van der Does | 271/24 |
| 3,866,901 | 2/1975 | Brock | 271/21 |
| 4,221,374 | 9/1980 | Kock | 271/21 X |

FOREIGN PATENT DOCUMENTS

| | | | |
|---|---|---|---|
| 2329927 | 1/1975 | Fed. Rep. of Germany | 271/22 |

*Primary Examiner*—Richard A. Schacher
*Attorney, Agent, or Firm*—Fitzpatrick, Cella, Harper & Scinto

[57] ABSTRACT

An apparatus removably mountable on an X-ray image photographing apparatus for supplying sheet films to the photographing apparatus is provided with an outlet, a chamber for holding a number of sheet films, a slit having a gap of such dimension into which a sheet film may enter, a transport member for transporting the outermost sheet to the outlet and prior to said transport, transporting that sheet film toward the slit, and a pressing member for downwardly curving the end of the remaining sheet films which is adjacent to the outlet.

17 Claims, 13 Drawing Figures

SHEET FILM SUPPLY APPARATUS

This is a continuation of application Ser. No. 230,501, filed Feb. 2, 1981, now abandoned.

BACKGROUND OF THE INVENTION

1. Field of the Invention

This invention relates to an apparatus for separating recording carriers one by one from a number of piled sheet-like information recording carriers and supplying the recording carriers to a recording apparatus.

2. Description of the Prior Art

In an X-ray image photographing apparatus for medical treatment, a sheet film is held between two intensifying screens and X-ray transmitted through an examinee is applied thereto to thereby expose the sheet film. Where an X-ray image is photographed with a relatively long time interval given for each sheet film, supply of sheet films may be effected by a supply apparatus of simple construction. However, where large-size sheet films are to be supplied at a high speed, for example, at a rate of several sheet films per second, great difficulty occurs and an application of an X-ray takes place with no sheet film set in place or the film conveyance path in the photographing apparatus is clogged with film.

Generally, where a number of sheet-like bodies are piled, it is often experienced that the action of static electricity or the like makes it difficult to separate the sheet-like bodies from one another. Particularly, where the sheet-like bodies are photographic films, static electricity is liable to occur and therefore, in the case of an apparatus for feeding films one by one from a pile of films contained therein, there often occurs the problem that a plurality of films are fed at one time or no film is fed at all.

As a means for separating sheet films in such an apparatus, there has heretofore been adopted a method which uses a sucking device to attract an uppermost sheet film and separate it from a pile of sheet films or a method which uses the friction force of a rubber roller or the like to separate a sheet film from the pile. However, the first-mentioned method has a disadvantage that much time is required to separate the piled sheet films one by one and moreover, the separating mechanism is large-scaled and complicated. The second-mentioned method has a disadvantage that is cannot always separate the piled sheet films one by one but may feed multiple sheet films at one time.

SUMMARY OF THE INVENTION

It is an object of the present invention to smoothly supply sheet-like information recording carriers to a recording apparatus.

It is another object of the present invention to reliably separate sheets one by one from a pile of sheets.

The supply apparatus according to the present invention is constructed so as to first transport the outermost sheet of a number of piled sheets in a direction opposite to an outlet and thereby separate only this sheet from the remaining sheets and then feed the separated sheet to a recording apparatus. Further, in an embodiment which will hereinafter be described, in order for the separation to be accomplished reliably there is provided one of the following: a slit (c, m) with a gap into which a sheet may enter is provided on the opposite side to an outlet (38,107), or a taper (0) for separating from a pile of sheets the opposite sides of the end of a sheet which is remote from the outlet, or a member (33, 98) for curving the end of the remaining sheets which is adjacent to the outlet.

The invention will become fully apparent from the following detailed description thereof taken in conjunction with the accompanying drawings.

DESCRIPTION OF THE PREFERRED EMBODIMENTS

Figure 13:
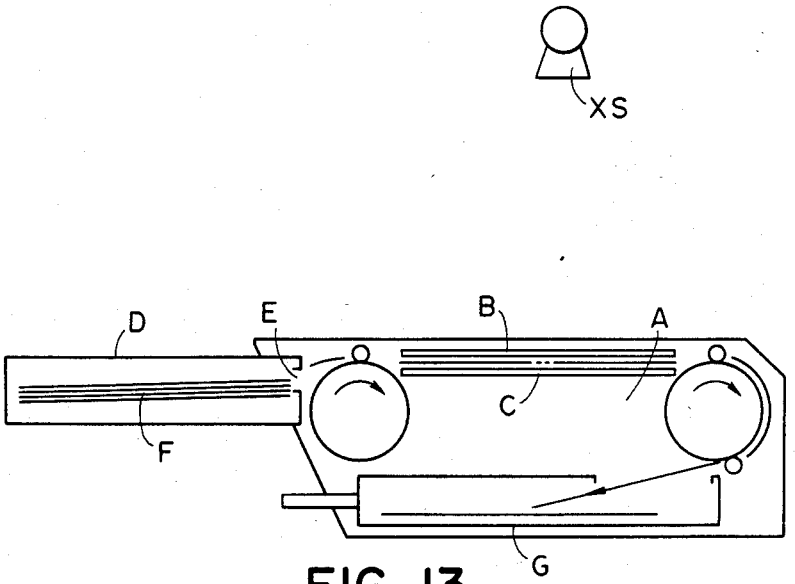
FIG. 13 is a cross-sectional view of a typical X-ray image photographing apparatus.

In FIG. 13, reference character XS designates an X-ray generator. A denotes an X-ray image photographing portion, and B and C designate intensifying screens. Sheet films may be set between the intensifying screens B and C. Designated by D is a supply magazine for supplying sheet films F to the photographing portion A. E denotes the outlet of the supply magazine from which the sheet films may be fed to the photographing portion A. The outlet E of the magazine is opened when the magazine is mounted on the photographing portion A, and is closed when the magazine is removed from the photographing portion A. G designates a receive magazine for containing therein sheet films which have been photographed. It may happen that the supply magazine is turned laterally or reversely during photography, but for the sake of convenience, the vertical direction thereof is defined in the shown condition.

Specific embodiments of the present invention will hereinafter be described by reference to the drawings. FIGS. 1–4 shows the sheet film supply magazine according to the present invention. In FIG. 2, reference numeral 2 designates a film receiver on which a number of sheet films F are piled, and the sheet films F may be fed from an outlet 38 toward the photographing portion. Denoted by 5 is a drive shaft driven by the body of the photographing portion (the power transmitting portion is not shown), and it rotates a rotary shaft 7 through bevel gears 6, 6' and further, a gear 8 fixed to the outer portion of this rotary shaft transmits the rotation to a gear 9 (FIG. 1) having the same number of teeth as the gear 8.

The gear 9 and a sprocket 11 are formed integrally with each other and are rotatably supported on a shaft 10 secured to a side plate 3. A chain 14 is passed over the sprocket 11 to thereby transmit the rotational force to a sprocket 12 as well.

Figure 4:
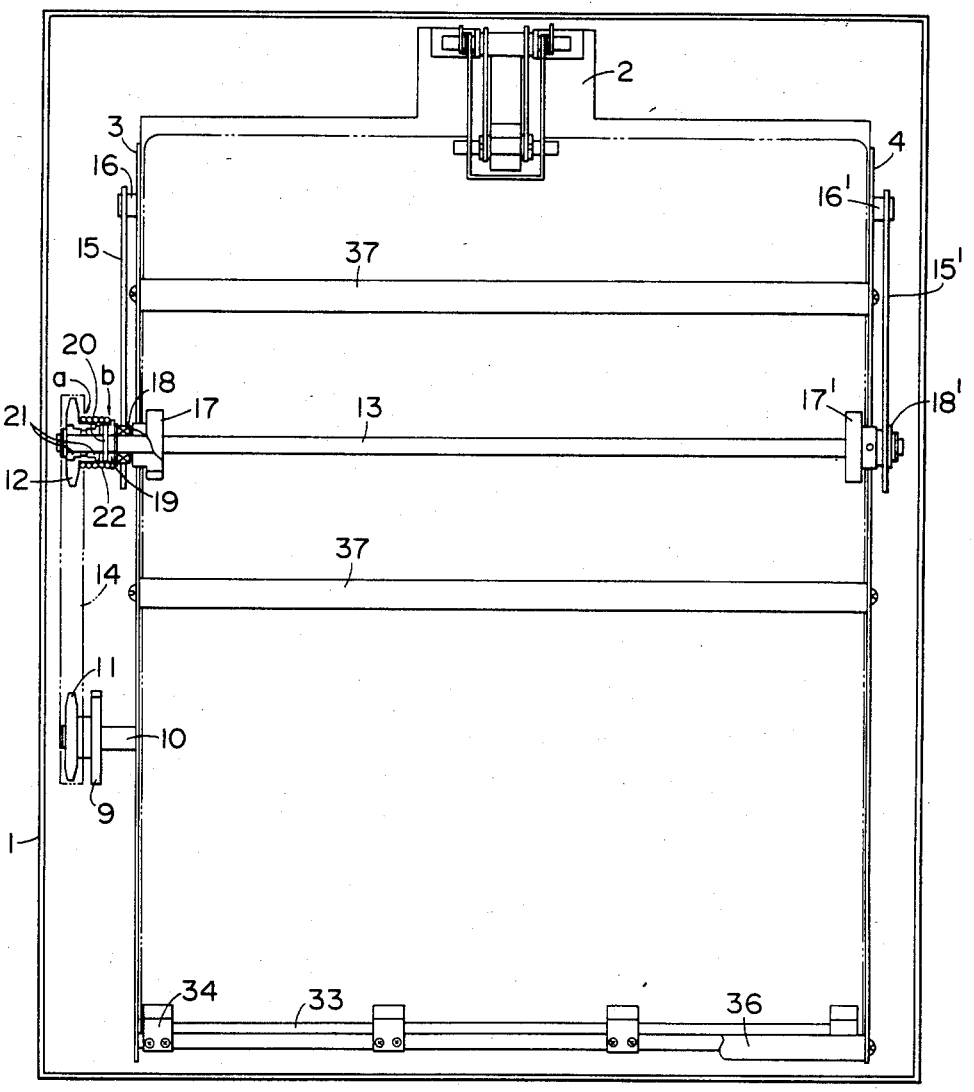
FIG. 4 is a plan view.

As shown in FIG. 4, film feeding rollers 17 and 17' are fixed to a rotary shaft 13 rotatably supported on levers 15 and 15' through bearings 18 and 18'. The levers 15 and 15' are pivotally supported on shafts 16 and 16' secured to side plates 3 and 4. A tension spring 23 (FIG. 1) biases the levers 15 and 15' so as to bring the film feeding rollers 17 and 17' into contact with the film F. A bearing 21 is rotatably fitted to the rotary shaft 13, and the sprocket 12 is rotatably fitted to the bearing 21. In close proximity to the cylindrical boss portion of the sprocket 12, a collar 19 equal in diameter to said boss portion is fixed to the rotary shaft 13 by a pin 20, and a tightening clutch spring 22 is fitted to the boss portion of the sprocket 12 and the collar 19 so as to make friction contact with the surfaces of the boss portion and the collar. In FIG. 4, the direction in which the tightening clutch spring 22 is turned is clockwise. Now, when the rotation of the drive shaft 5 causes counter-clockwise rotation of the sprocket 12 as viewed in FIG. 1, a portion a of the tightening clutch spring 22 fitted to the boss of the sprocket 12 is fastened counter-clockwise, as viewed from the arrow side of FIG. 4, by friction force. Therefore, the sprocket 12 and the collar 19 can be rotated together, and the film feeding rollers 17 and 17' fixed to the rotary shaft 13 are also rotated counter-clockwise. Conversely, when the sprocket 12 is rotated clockwise as viewed in FIG. 1, clockwise rotational force can be transmitted to the film feeding rollers 17 and 17' by virtue of the fitting of the tightening clutch spring 22 to the sprocket 12 and the collar 19, but when there is a slight counter-clockwise rotation resistance in the rollers 17 and 17', a portion b of the tightening clutch spring 22 is loosened counter-clockwise, as viewed from the arrow side of FIG. 4, by the friction force with the collar 19 while, at the same time, the integral relation between the collar 19 and the sprocket 12 is released and the sprocket 12 rotates idly.

Slit forming members 24 and 25 are integral with each other, and a slit c formed by these only has a gap corresponding to the thickness of a sheet film, and one sheet film can be separated by inserting a returned sheet film F' into the slit. The slit forming member 24 is rotatably supported on a shaft 28 provided on a lever 26 rotatably installed on a shaft 29, and by the biasing force of a torsion spring 30 and by a roller 31 secured to the slit forming member 25 being vertically moved with a roller guide plate 32 as the guide, the surface d of the slit forming member 24 is normally brought into contact with the upper surface of the sheet film F. The upper slit forming member 24, with the film receiver 2, has the function of gripping the sheet film F'.

Designated by 33 is a film keep roller for depressing the photographing portion side end of the piled sheet films F other than the uppermost sheet film F' and curving the films. Denoted by 34 is a guide pawl which provides a guide when the leading end of the piled sheet films F other than the uppermost sheet film F' is depressed and the uppermost sheet film F' is fed to the photographing portion. Designated by 35 is a stopper for preventing the piled sheet films F from being fed toward the photographing portion when the uppermost sheet film F' is fed to the photographing portion. These three members are integrally fixed to side plates 3 and 4.

The operation sequence of the sheet film supply magazine, which is according to the present invention and is constructed as described above, will now be described by reference to FIGS. 1–4.

Figure 1:
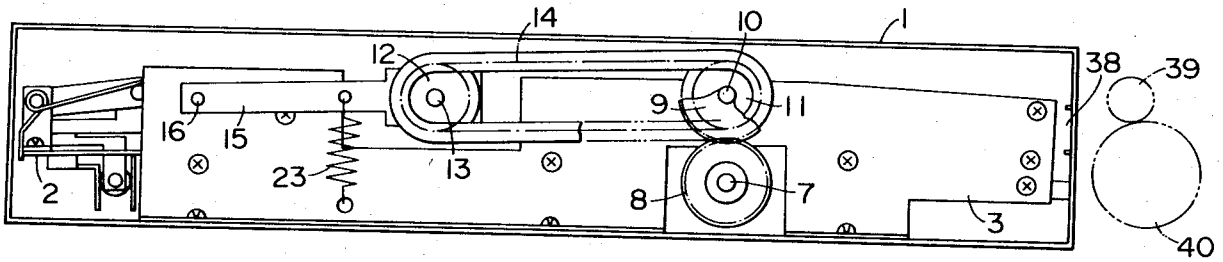
FIG. 1 is a longitudinal cross-sectional view showing a first specific embodiment of the present invention.
Figure 2:
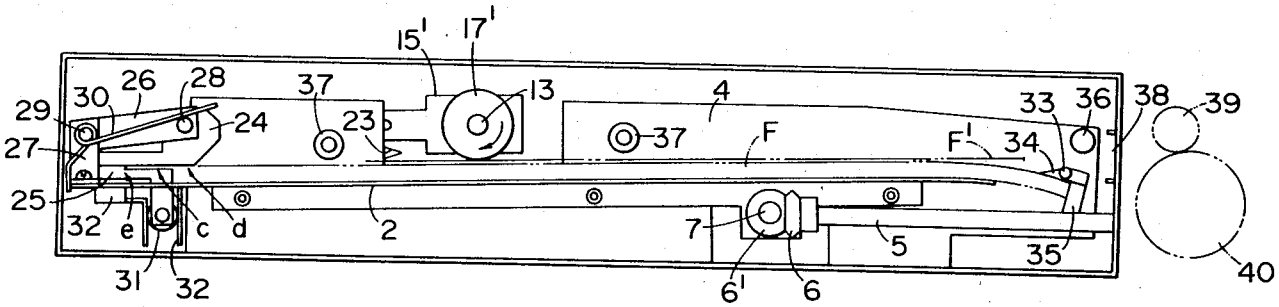
FIG. 2 is a longitudinal cross-sectional view showing the manner in which a sheet film is transported in a direction opposite to an outlet.
Figure 3:
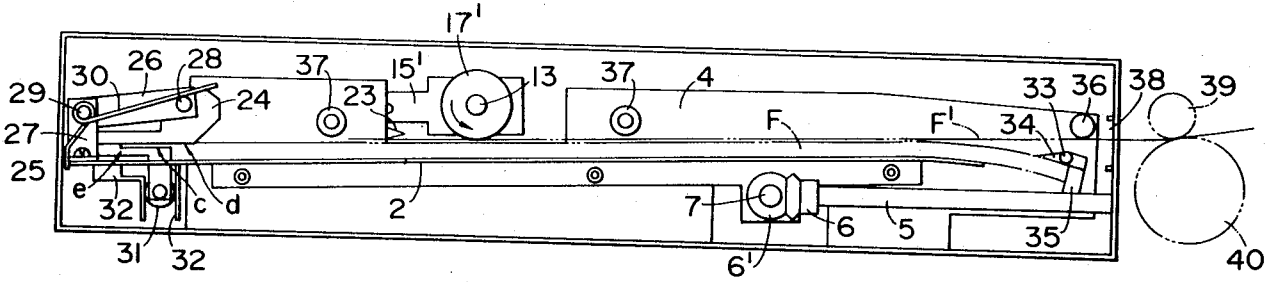
FIG. 3 is a longitudinal cross-sectional view showing the manner in which a sheet film is fed.

FIG. 1 is a side view of the sheet film supply magazine showing a condition in which the film feeding rollers 17 and 17' are in contact with the uppermost sheet film F'. FIG. 2 is a cross-sectional view showing a condition in which the uppermost sheet film F' has been returned to the opposite side to the photographing portion by reverse rotation of the rollers 17 and 17' and inserted into the slit c formed by the slit forming members 24 and 25. FIG. 3 is a cross-sectional view showing a condition in which the uppermost sheet film F' has been fed to the photographing portion by normal rotation of the rollers 17 and 17' and inserted into between feed rollers which are disposed adjacent to the body of the photographing portion. FIG. 4 shows a plan view in stopped condition.

When the sheet film supply magazine is not mounted on the body of the photographing portion, the film feeding rollers 17 and 17' are not in contact with the sheet film but assume their upper position, and when the sheet film supply magazine has been mounted on the body of the photographing portion, the film feeding rollers 17 and 17' can make contact with the sheet film with the aid of an unshown mechanism. In FIG. 2, when such a drive force that the film feeding rollers 17 and 17' are rotated reverse (clockwise) is imparted from the body of the photographing portion, the uppermost sheet film F' is returned to the opposite side to the photographing portion and the central portion of the trailing end of the sheet film F' is inserted into the slit c formed by the slit forming members 24 and 25. At this time, the uppermost sheet film F' is separated from the other piled sheet films F and simultaneously therewith, the end of the sheet film F' which is adjacent to the photographing portion is disengaged from the film keep roller 33 and the guide pawl 34. At a point of time whereat the uppermost sheet film F' has been sufficiently returned and the trailing end of the film strikes against the innermost portion e of the slit, a counter-clockwise rotation resistance is produced in the film feeding roller 17' of FIG. 2 and therefore, as previously described, the portion b of the tightening clutch spring 22 is loosened counter-clockwise as viewed from the arrow side of FIG. 4 while, at the same time, the integral relation between the collar 19 and the sprocket 12 is released and only the sprocket 12 rotates idly and thus, the sheet film F' is not returned any further.

Next, when a drive force in the opposite direction to that described above is imparted from the body of the photographing portion, the portion a of the tightening clutch spring 22 is fastened counter-clockwise as viewed from the arrow side of FIG. 4, and such a drive force that the film feeding roller 17' is rotated in normal direction (counter-clockwise direction) as viewed in FIG. 3 is transmitted to the film feeding roller 17' and thus, only the uppermost sheet film F' can be fed toward the photographing portion. At this time, the piled sheet films F other than the uppermost sheet film F' are prevented from being fed toward the photographing portion by the stopper member 35.

Figure 5:
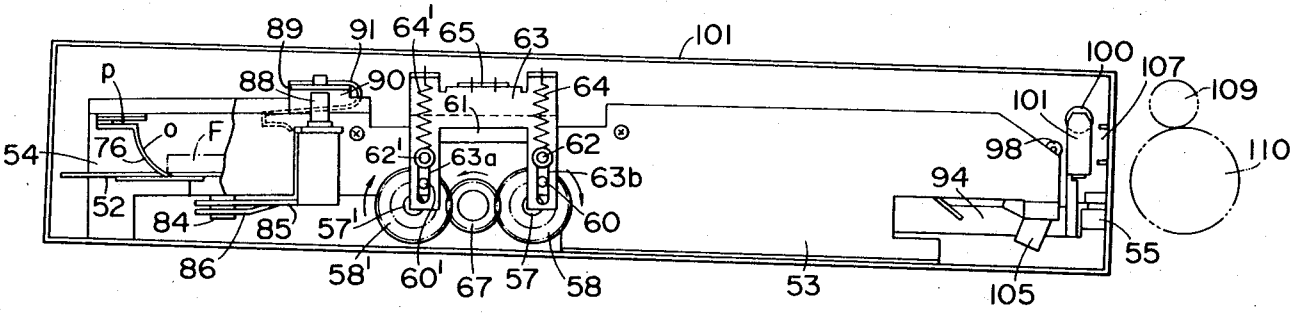
FIG. 5 is a longitudinal cross-sectional view showing a second specific embodiment of the present invention.
Figure 6:
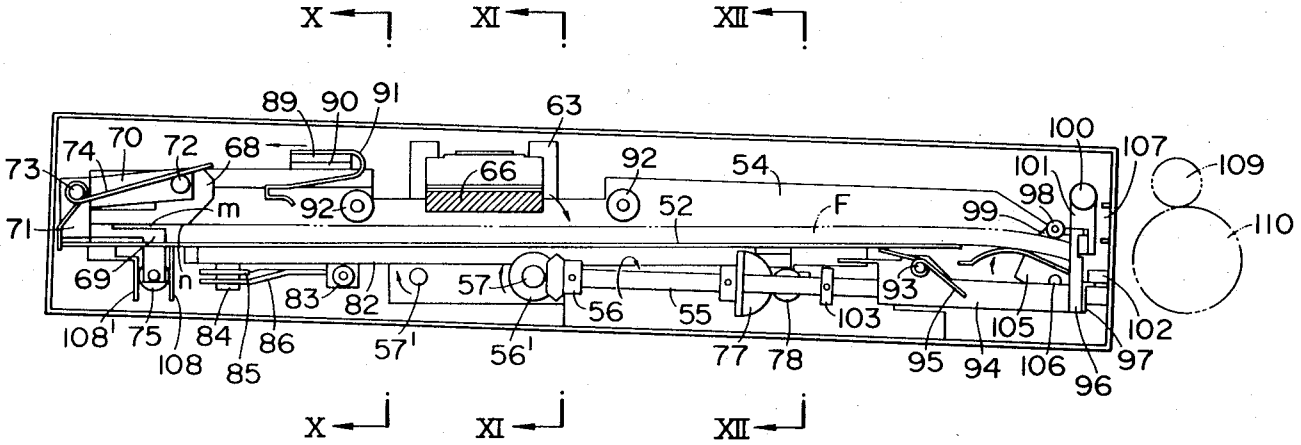
FIG. 6 is a longitudinal cross-sectional view showing the manner in which a sheet film is transported in a direction opposite to an outlet.

FIGS. 5–12 show a second specific embodiment of the present invention. In FIG. 6, reference numeral 52 designates a film receiver on which a number of sheet films F are piled. The sheet films F are fed one by one from an outlet 107 toward the photographing portion. Designated by 55 is a drive shaft driven from the body of the photographing portion (the power transmitting portion is not shown). The drive shaft 55 rotates a rotary shaft 57 through the agency of bevel gears 56 and 56', and further transmits the rotation to a rotary shaft 57' as well through a gear fixed to the outer portion of the rotary shaft 57, an idler gear 67 and a gear 58'. By causing shafts 60 and 60' secured to the gears 58 and 58' of FIG. 5 to rotate in the same phase, shafts 62 and 62' secured to a connecting plate 61 supported on the shafts 60 and 60' are also rotatively parallel-moved in the same phase.

A slide plate 63 is a sheet metal holding a return member 66, and is pivotally supported on shafts 62 and 62' so that slotted portions 63*a* and 63*b* freely slide vertically relative to the shafts 62 and 62' secured to the connecting plate 61. Between the slide plate 63 and the shafts 62, 62', tension springs 64 and 64' are provided to normally bias the return member 66 downwardly as viewed in the drawing. Synchronous rotations of the gears 58 and 58' in clockwise direction (direction of arrow) rotatively, parallel-move the shafts 62 and 62' through the agency of the shafts 60, 60' and the connecting plate 61, whereby the slide plate 63 and the return member 66 (FIG. 6) are rotatively, parallel-moved in clockwise direction (direction of arrow). The return member 66 may be formed of a highly frictional material such as sponge and short needles may be embedded therein. At a point of time whereat the return member 66 makes contact with the uppermost sheet film F' when the return member 66 is rotatively, parallel-moved, the shafts 62 and 62' continue to rotatively, parallel-move. Accordingly, by the slotted portions of the slide plate 63 sliding relative to the shafts 62 and 62', the return member 66 moves so as to return the uppermost sheet film F' to the opposite side to the photographing portion while maintaining its contact with the uppermost sheet film F'. As the shafts 62 and 62' are further rotatively, parallel-moved, these shafts 62 and 62' bear against the uppermost portions of the slots in the slide plate 63, and the return member 66 becomes disengaged from the uppermost sheet film F', and the slide plate 63 and the return member 66 are rotatively, parallel-moved similarly to the shafts 62 and 62'.

Slit forming members 68 and 69 (FIG. 6) are formed integrally with each other, and a slit (m) formed by these only has a gap corresponding to the thickness of a sheet film and only one sheet film may be separated by inserting the returned sheet film into the slit.

The slit forming member 68 is rotatably supported on a shaft 72 provided on a lever 70 rotatably installed on a shaft 73. Further, the surface n of the slit forming member 68 is normally brought into contact with the upper surface of the sheet film F by the biasing force of a torsion spring 74 and by a roller 75 secured to the slit forming member 69 being vertically moved with roller guide plates 108, 108' as the guide.

Figure 10:
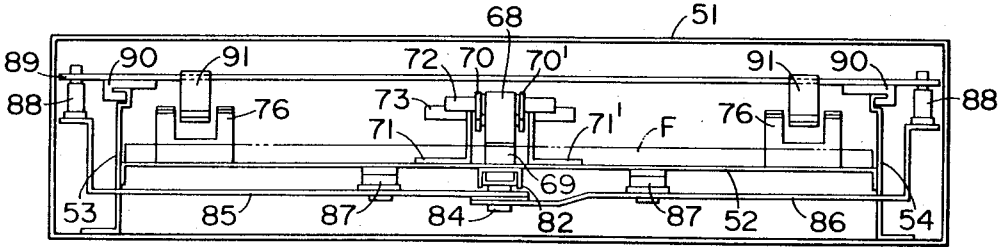
FIG. 10 is a cross-sectional view taken along line X—X of FIG. 6.

In FIGS. 5 and 10, reference numeral 76 designates a tapered member for upwardly curving, along the portion 0 of the member, the opposite side portions of the trailing end of the sheet film F returned in the opposite direction to the photographing portion and directing the same to a slit provided in the upper portion of the member. By this tapered member, a space is created between that sheet film and the other piled sheet films to enable the sheet film F' to be fed to the photographing portion and at the same time, to effect the positioning of the trailing end of the sheet film F'.

A cam 77 (FIG. 6) fixed to the drive shaft 55 is a cylindrical cam for moving a scrape-out pawl 91 back and forth. By rotation of the cylindrical cam 77, a lever 79 (FIG. 8) is pivotally moved about a pivot shaft 80 through a cam follower roller 78. The pivotal movement of the lever 79 causes sliding movement of a roller 81, which in turn causes sliding movement of a connecting lever 82 on which the roller 81 is provided. A shaft 84 secured to the connecting lever 82 is fitted in the slots of scrape-out levers 85 and 86 and therefore, when the connecting lever 82 slides, the scrape-out levers 85 and 86 pivotally move about a pivot shaft 87.

In FIG. 5, reference numeral 88 designates a pin secured to the scrape-out levers 85 and 86 and fitted in the slot of a sheet metal 89. Accordingly, by the pivotal movement of the scrape-out levers 85 and 86, a guide 90 secured to the sheet metal 89 is caused to slide with the grooves of side plates 53 and 54 as the guide, whereby the sheet metal 89 slides back and forth.

Designated by 91 is a scrape-out pawl secured to the sheet metal 89. This scrape-out pawl 91 is engageable with the opposite side portions of the trailing end of a sheet film F' directed to the slit P of the tapered member 76 to feed the sheet film F' toward the photographing portion. The cam follower roller 78 is adapted to trace the camming surface of the cylindrical cam 77 with the aid of a spring (not shown).

Reference numeral 98 on the right-hand side of FIG. 6 designates a film keep roller for depressing the photographing portion side end of the piled sheet films F other than the uppermost sheet film F'. Designated by 99 is a guide pawl which provides a guide when the leading end of the piled sheet films F other than the uppermost sheet film F' is depressed and the uppermost sheet film F' is fed toward the photographing portion. Denoted by 100 is a guide roller. Reference numeral 96 designates a stopper for preventing the piled sheet films other than the uppermost sheet film F' from being fed toward the photographing portion when the uppermost sheet film F' is fed to the photographing portion. These four members (96, 98–100) are integrally fixed to the sheet metal 94 and are normally raised upwardly about a pivot shaft 93 to a position to strike against a stopper 102, by the biasing force of torsion spring 95. Designated by 103 is a film keep roller vertically moving cam having a roller 104 secured thereto. It is fixed to the drive shaft 55. By rotation of this film keep roller vertically moving cam 103, the roller 104 can be caused to bear against the extension of the sheet metal 94, whereby with the sheet metal 94, the film keep roller 98, the guide pawl 99, the guide roller 100 and the stopper 96 can be caused to pivot vertically about the pivot shaft 93.

However, since the position of the film keep roller 98 is always fixed, the degree of curvature of the piled sheet films F decreases as the number of the piled sheet films F decreases. Accordingly, it may sometimes happen that the effect of the uppermost sheet film F' being separated from the other piled sheet films F decreases when the uppermost sheet film F' is once returned in the opposite direction to the photographing portion and then fed toward the photographing portion by the scrape-out pawl 91. Provided to cover this disadvantage is a film raising sheet metal 105. This is a sheet metal for raising the neighborhood of the end of the sheet films which is adjacent to the photographing portion, and is biased in the direction of arrow about a pivot shaft 106 by a tension spring (not shown). As the number of films F decreases, the rigidity of the piled films F decreases, but since a constant force is always imparted to the film raising sheet metal 105 in the direction of arrow indicated in FIG. 5, the degree of curvature of the piled films F increases as the number of films decreases.

Accordingly, in spite of the position of the film keep roller 98 being fixed, the effect of the uppermost sheet film F' being separated from the other piled sheet films F is maintained substantially constant by virtue of the action of the film raising sheet metal 105.

The operation sequence of the sheet film supply magazine according to the present invention constructed as described above will now be described by reference to FIGS. 5–12.

Figure 7:
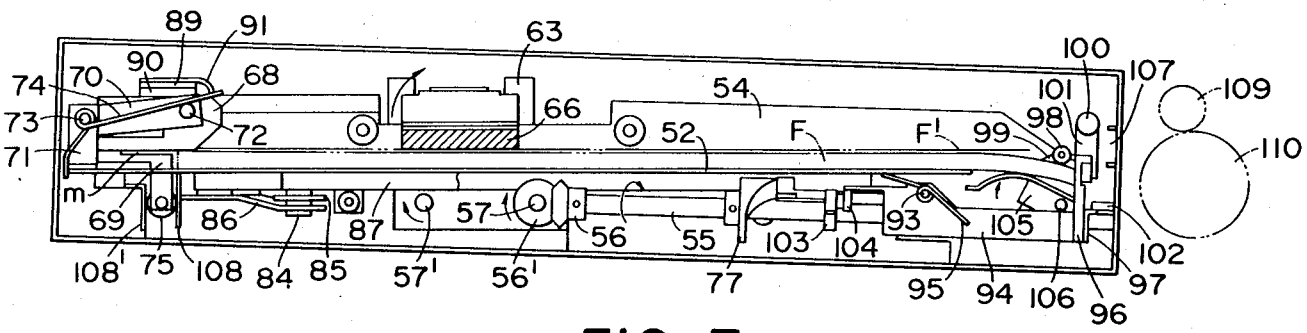
FIG. 7 is a longitudinal cross-sectional view showing the manner in which a sheet film is inserted into a slit.
Figure 8:
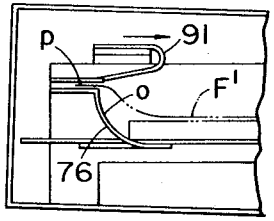
FIG. 8 shows the taper of the second specific embodiment.
Figure 9:
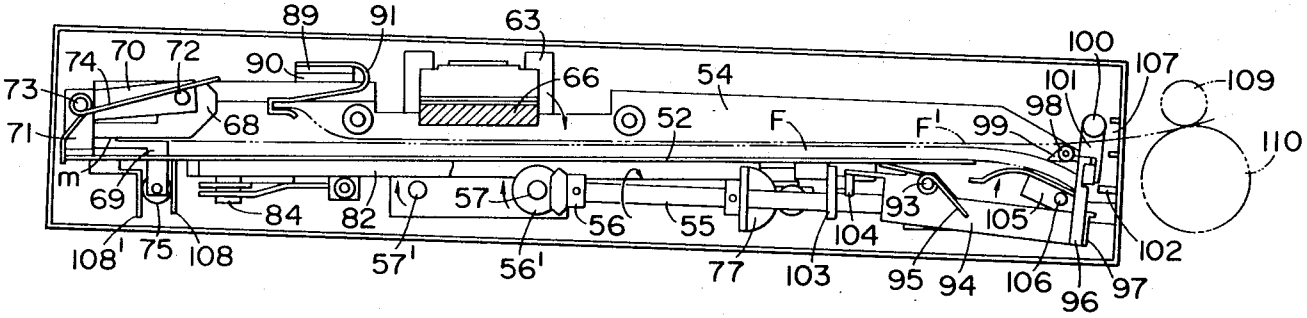
FIG. 9 shows the manner in which a sheet film is fed.
Figure 11:
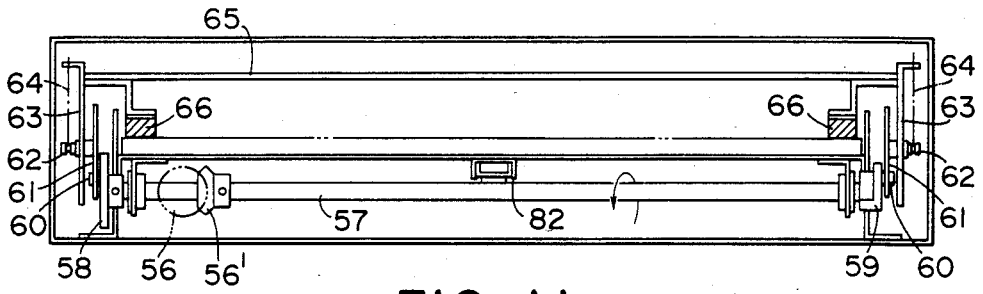
FIG. 11 is a cross-sectional view taken along line XI—XI of FIG. 6.
Figure 12:
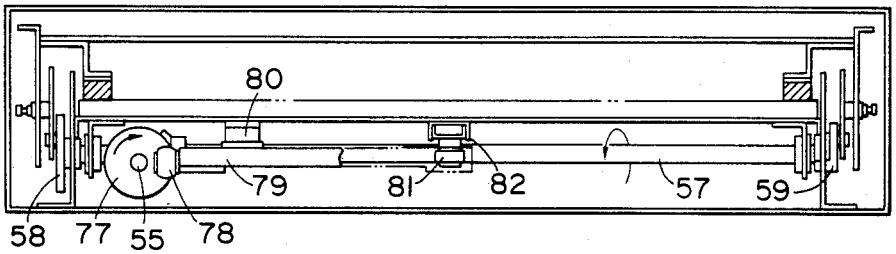
FIG. 12 is a cross-sectional view taken along line XII—XII of FIG. 6.

FIG. 5 is a side view of the sheet film supply magazine of the present invention in its stopped condition; FIG. 6 is a cross-sectional view thereof; FIG. 7 is a cross-sectional view showing a condition in which the uppermost sheet film F' has been returned to the opposite side to the photographing portion and inserted into the slit formed by the slit forming members 68 and 69; FIG. 8 is a view showing a condition in which the opposite side portions of the trailing end of the sheet film F' has been directed to the tapered member 76; and FIG. 9 is a cross-sectional view showing a condition in which the uppermost sheet film F' has been fed toward the photographing portion and inserted into between the feed rollers on the photographing portion body side. FIGS. 10–12 are cross-sectionals taken along line X—X, line XI—XI and line XII—XII, respectively, in FIG. 6.

In FIG. 6 which shows the stopped condition of the sheet film supply magazine, the sheet films F are piled on the film receiver 52 and the return member 66 is not in contact with the uppermost sheet film F', and the scrape-out pawl 91 is about to return in the direction of arrow. Also, the film keep roller 98 is only slightly depressing the end of the sheet films F which is adjacent to the photographing portion so that the uppermost sheet film F' can readily be returned to the opposite side to the photographing portion.

When, in such a condition, a drive force which rotates the drive shaft 55 is transmitted from the photographing portion body (the power transmitting portion is not shown), the rotary shafts 57 and 57' first begin to rotate and at the same time, the return member 66 is rotatively, parallel-moved in clockwise direction (direction of arrow). Soon the return member 66 begins to make contact with the uppermost sheet film F'. During the time that the shafts 60 and 60' make one-half rotation about the gears 58 and 58', the return member effects a linear movement while maintaining its contact with the uppermost sheet film F' and returns the uppermost sheet film F' to the opposite side to the photographing portion, so that the central portion of the trailing end of the sheet film F' is inserted into the slit (m) formed by the slit forming members 68 and 69 (FIG. 7). Simultaneously therewith, the opposite side portions of the trailing end of the returned uppermost sheet film F' are curved and lifted along the portion n of the tapered member 26 to assume such a state as shown in FIG. 8. Before such a state is reached, the scrape-out pawl 91 returns to its position as shown in FIG. 7.

When the shafts 60 and 60' further continue to rotatively, parallel-move in clockwise direction, the return member 66 becomes disengaged from the uppermost sheet film F' and rotatively, parallel-moves similarly to the shafts 60 and 60'.

After the return member 66 has been disengaged from the uppermost sheet film F', the scrape-out pawl 91 begins to move toward the photographing portion with the aid of the action of the scraping-out cylindrical cam 77 and engages the opposite side portions of the trailing end of the uppermost sheet film F' to feed the sheet film F' to the photographing portion. Immediately before this scrape-out operation is started, the film keep roller 98, the guide pawl 99, the guide roller 50 and the stopper 96 are depressed downwardly as viewed in the drawing with the aid of the action of the film keep roller vertically moving cam 103 to thereby depress the photographing portion side end of the sheet film F other than the uppermost sheet film F', whereby only the uppermost sheet film F' can be fed toward the photographing portion body.

What we claim is:

1. A supply apparatus, comprising:

support means for supporting a plurality of sheets;

an outlet for feeding out an uppermost sheet of said sheets therethrough, said outlet being provided at one end side of said support means;

means for forming a gap of such dimension into which an end of the uppermost sheet opposite to said outlet may enter, said gap forming means being provided at a second end side of said support means opposite to said outlet;

slide means for sliding the uppermost sheet into said gap;

spacing means disposed on at least one side of said gap forming means with respect to a direction perpendicular to the direction along which said outlet and said gap forming means are provided to space the uppermost sheet apart from the remaining sheets while the uppermost sheet is slid by said slide means; and carrying means for carrying the uppermost sheet to said outlet from said gap.

2. A supply apparatus according to claim 1, wherein said spacing means comprises an arcuate slope gradually rising from the level of the uppermost sheet.

3. A supply apparatus according to claim 1, further comprising restraining means for restraining the end of the pile of sheets which is opposite to said means for forming said gap.

4. A supply apparatus according to claim 3, wherein said restraining means has downward pressing means for pushing the pile of sheets downwardly.

5. A supply apparatus according to claim 1, further comprising restraining means for restraining the end of the pile of sheets which is opposite to said means for forming said gap, and upward pressing means disposed adjacent to said restraining means to push the pile of sheets upwardly.

6. A supply apparatus according to claim 1, wherein said carrying means has a reciprocally movable pawl.

7. A supply apparatus according to claim 1, wherein said means for forming said gap is movable in the direction in which the sheets are piled.

8. A supply apparatus according to claim 7, wherein said means for forming said gap has a contact portion which normally makes contact with the outermost surface of the pile of sheets.

9. A sheet feeder, comprising:

means for supporting a plurality of sheets;

an outlet for feeding out an uppermost sheet of said sheets therethrough, said outlet being provided at one end side of said support means;

separating means, providing a space to allow entrance of an end of the uppermost sheet opposite to said outlet, for separating the uppermost sheet from the plurality of sheets, said separating means being provided at the other end side of said supporting means opposite to said outlet;

first moving means for moving the uppermost sheet to said space;

means for raising both corner sides of said end of the uppermost sheet from the plurality of sheets while the uppermost sheet is moved by said first moving means; and second moving means for moving the uppermost sheet away from the space toward said outlet by pushing said end of the uppermost sheet opposite to said outlet.

10. A feeder according to claim 9, further comprising lowering means for lowering the ends of the remaining sheets adjacent said outlet, prior to operation of said second moving means.

11. A feeder according to claim 9, wherein said raising means comprises a pair of sloping surfaces gradually rising from the level of the uppermost sheet.

12. A feeder according to claim 11, wherein said separating means comprises additional spaces positioned at a level different from said space, said additional spaces being continuously aligned with said sloping surfaces, respectively.

13. A feeder according to claim 12, wherein said space positioned at a lower level is located between said additional spaces.

14. A feeder according to claim 9, wherein said first moving means includes a member which is displaceable, rotatable and adapted to contact with a sheet.

15. A feeder according to claim 14, wherein said displaceable member has a highly frictional surface.

16. A feeder according to claim 9, wherein said second movable means includes a reciprocable hook.

17. A feeder according to claim 10, further comprising pressing means disposed adjacent to said lowering means to push the pile of sheets upwardly.

* * * * *